US005241307A

United States Patent [19]

Bidault et al.

[11] Patent Number: 5,241,307

[45] Date of Patent: Aug. 31, 1993

[54] SOUND SIGNALING GENERATION DEVICE FOR PEDESTRIANS

[75] Inventors: Gérard Bidault, Vouille; Dominique Leveque, Champigny le Sec, both of France

[73] Assignee: Societe d'Etudes et de Fabrication Electronique et Radioelectrique-S.E.F.E.R., Neuville de Poitou, France

[21] Appl. No.: 802,324

[22] Filed: Dec. 4, 1991

[51] Int. Cl.[5] ..... G08G 1/095; G08G 1/07; G08B 27/00; G08B 25/08

[52] U.S. Cl. ..... 340/944; 340/925; 340/326; 340/692

[58] Field of Search ..... 340/944, 925; 381/57, 381/56, 30, 51, 326, 692; 367/198, 199; 341/24

[56] References Cited

U.S. PATENT DOCUMENTS

| | | | |
|---|---|---|---|
| 3,134,089 | 5/1964 | Bogoff et al. | 340/944 |
| 3,596,238 | 7/1991 | Siklos | 340/944 |
| 4,253,083 | 2/1981 | Imamura | 340/944 |
| 4,851,836 | 7/1989 | Wilkinson et al. | 340/944 |
| 5,083,310 | 1/1992 | Drory | 381/30 |
| 5,097,113 | 3/1992 | Aoyama | 341/24 |

FOREIGN PATENT DOCUMENTS

| | | | |
|---|---|---|---|
| 0172419 | 8/1986 | Japan | 381/57 |
| 0239699 | 9/1989 | Japan | 340/925 |
| 0166699 | 7/1991 | Japan | 340/925 |

*Primary Examiner*—Jin F. Ng
*Assistant Examiner*—P. Wong
*Attorney, Agent, or Firm*—Felfe & Lynch

[57] ABSTRACT

Sound signaling and optical signaling at a crosswalk are both activated by a single push button. An activation of optical signaling such as green and red figurines is immediate, whereas the transmission of a sound message authorizing or forbidding a crossing is activated only when the pedestrian pushes the button for a predetermined time. The generation device for sound signals is controlled by a microprocessor including logic and analog inputs and outputs, the messages being stored in digital form and transmitted according to the ADPCM method.

10 Claims, 3 Drawing Sheets

SOUND SIGNALING GENERATION DEVICE FOR PEDESTRIANS

BACKGROUND OF THE INVENTION

The present invention concerns a sound signaling generation device for pedestrians including first activating means designed for activation upon request, to be synchronized with at least one optical signaling generation device which in its turn is synchronized with at least one road traffic light, and activated upon request by an activating maneuver to be exerted on a second activating means.

Optical signaling for pedestrians, in particular with the help of green or red figurines indicating whether the crossing of a road way is authorized or forbidden, is well known today by users. In some countries, figurines are replaced by the indications "Walk" and "Don't Walk". In order that blind persons may benefit from a sound signaling, the latter must include a sound device.

Such a sound device is provided by the French Patent Application FR-A-2 627 882. It includes a loud speaker activated by an ultrasonic receiver which is arranged for receiving an ultrasonic request signal transmitted from a remote control housing with a push-button. When this remote control housing push-button is activated, the ultrasonic request signal is stored while waiting for a green figurine for pedestrians to appear, which launches the transmission of an audible message.

Such a device of course brings the advantage that the sound signaling is operated only upon request and not continuously, which could trouble the neighborhood because of an infinite repetition of the same crossing authorization and forbidding messages. On the other hand, this device has the disadvantage of being relatively expensive, especially if each blind person is provided with his own remote control housing. In addition, it seems difficult for a single four road crossing or a more complex one to forecast which crossing he intends to undertake. The situation will be even more complicated if several blind persons simultaneously arrive at the same crossing.

The present invention aims at overcoming these inconveniences.

SUMMARY OF THE INVENTION

According to the present invention, the first activating means of the sound signaling generation device and the second activating means of the optical signaling generation device are one and the same activating means. The sound signaling generation proper is only activated if the activation maneuver is maintained for at least one predetermined delay period. Some infrequently used pedestrian crossings are activated upon request by a pedestrian maneuvering a push-button, for instance. This activating maneuver is immediately taken into account to stop the road traffic and authorize pedestrians crossing. The present invention generalizes the use of this push-button which keeps its known use for activating the optical signaling, but also brings a sound signaling activation when the activating maneuver, exerted upon the pushbutton, is maintained for a longer duration, i.e. for some delay duration. The predetermined delay duration can be adjustable, for instance between one and two seconds.

Since the optical signaling includes a first figurine activated by a first control signal and a second figurine activated by a second control signal, and since the sound signaling includes a first sound control for controlling transmission of a first sound message and a second sound control for controlling transmission of a second sound message, it preferably is provided that the first sound control is activated by the first control signal and that the second sound control is activated by the second control signal. The control of a figurine generally consists of an electric wire which causes lighting up the green or red figurines, depending upon the case, and it is advantageous to use these electric signals for activating the authorization or forbidding sound transmission control means.

It is clear that the figurines normally are activated in an alternative manner, and are mutually exclusive. It is then an advantage that the sound signaling generation device includes error detection means, detecting either the simultaneous absence or the simultaneous presence of the first and second control signals. An error signal is transmitted if the detected simultaneity lasts beyond a predetermined duration corresponding to the duration of the control state change for the first and second figurines. That is, on the basis of a detected erroneous simultaneity, the sound signaling device should provide for the detection of an error or a breakdown of the optical signaling system, but it should not detect an error when this simultaneity is normal, i.e. of short duration.

Advantageously, the sound signaling generation device is controlled by a programmable microprocessor including logic and analog input/output terminals.

With such a microprocessor including at least four analog input terminals, it is advantageous to connect these terminals with:

a. an adjustment potentiometer for adjusting the minimum message transmission volume,
b. an adjustment potentiometer for adjusting the maximum message transmission volume,
c. an ambient sound level sensor,
d. an adjustment potentiometer for adjusting the predetermined period duration of the simultaneity detection.

It is thus possible to benefit from the fact that the microprocessor is programmable to set a maximum and a minimum message transmission volume, choose an appropriate level between this maximum and this minimum as a function of the ambient sound level, and to finally adapt the simultaneity detection, i.e. the error detection, for various cases which can appear, for instance the length of the pedestrians crossing.

With a programmable microprocessor including, for instance, eight dual-level logic input terminals, it is advantageous if each terminal is connected to one of eight dual-position switches to be positioned to determine:

a. whether the microcontroller operates in a continuous way or upon pedestrian's request,
b. whether or not each message is transmitted in the first language,
c. whether or not each message is transmitted in a second language,
d. whether each message is transmitted with a street name,
e. whether or not a message is transmitted if crossing is forbidden,
f. whether or not a coded message is transmitted in case crossing is forbidden, g. whether or not an automatic volume control is activated, h. whether or not the delay of the activation means, i.e. the push-button, is activated.

The switches obviously are to be activated by the installation company, and not by the users. The company will position them as a function of the road crossing and the microprocessor programming can remain unchanged, whichever options are chosen for each particular case.

For sensing the ambient sound level, the sound signaling device is provided with a connection with at least one sound waves transmitter/sensor apparatus for alternatively transmitting the messages, then sensing the ambient sound level. Whatever the number of connected transmitter/sensor apparatuses is, in particular four, they are connected in parallel for an average measurement of the ambient sound level.

For the message transmission, several technical devices can be considered. Preferably, the messages to be transmitted are cut in message portions which are stored in digital form during a preparation phase. The messages are restored by a concatenation of the pertinent message portions and reconstructed by means of a digital decompression device during an operation phase.

The present invention will be better understood with the help of the description of a non limiting embodiment illustrated by the drawings.

DETAILED DESCRIPTION OF THE PREFERRED EMBODIMENT

Figure 1:
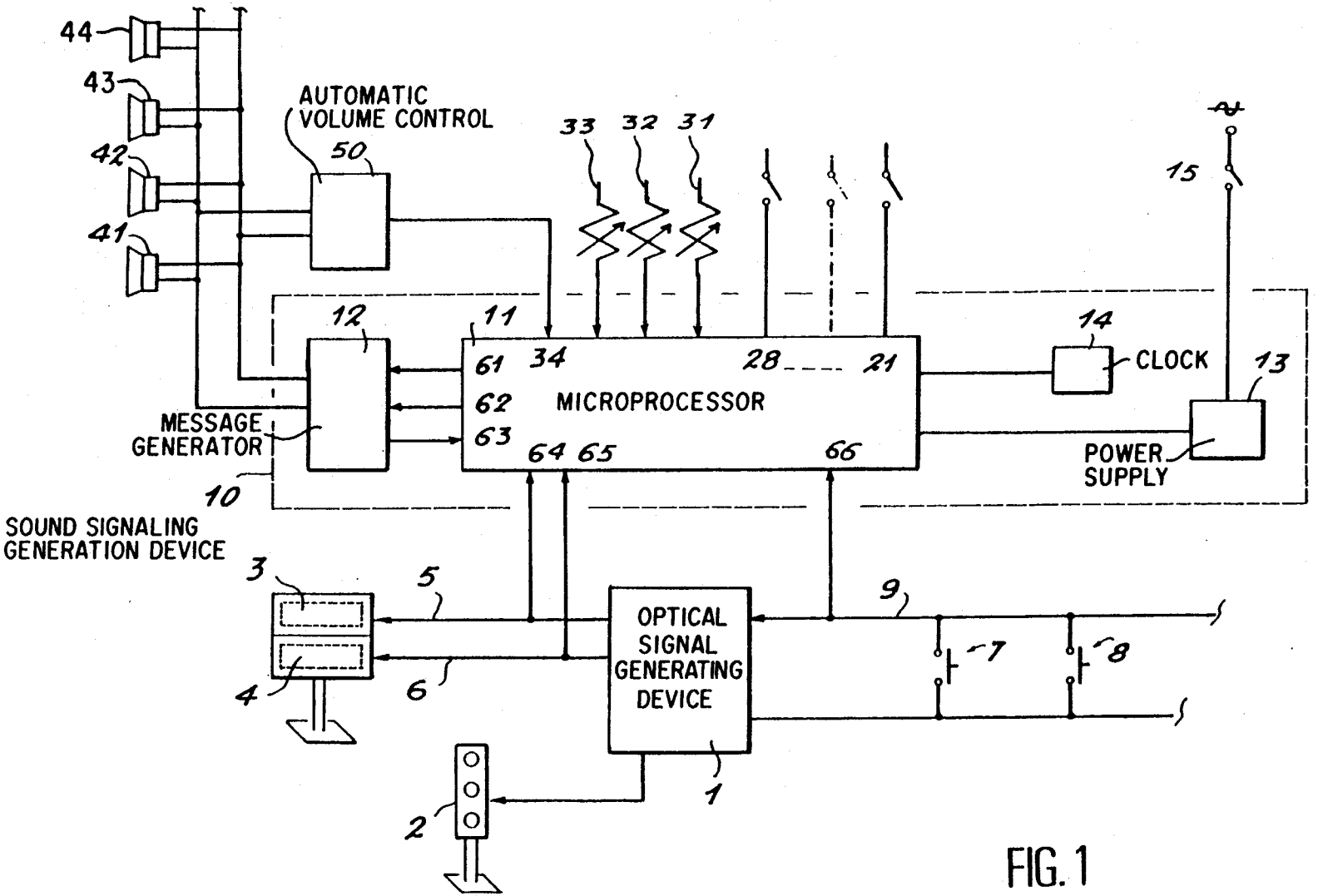
FIG. 1 represents a schematic diagram of the sound signaling generation device for pedestrians according to the invention.

FIG. 1 shows an optical signal generating device 1 which controls at least one three color traffic light 2 for automobiles, and a pedestrian signaling device with a first figurine 3 being activated by a first control signal 5 and a second figurine 4 being activated by a second control signal 6. The first figurine for instance is a green figurine authorizing the crossing whereas the second, red figurine corresponds to crossing being forbidden. These two figurines are totally mutually exclusive and they are not simultaneously lit up, nor simultaneously switched off, except for the state change periods.

The controller may operate continuously, as usual, but it also can be activated upon request by an activating maneuver to be exerted on an activation means, for instance a push button 7, possibly in parallel connection with another push button 8, to send the request signal 9 which is immediately dealt with by the controller The sound signaling generation device for pedestrians 10 essentially is made up of a programmable microprocessor 11, a message generator circuit 12, a power supply 13, a clock 14 and a general switch 15. The programmable microprocessor 11 is of a known type, for instance part number UPD78CP14 built by the NEC company. The programmable microprocessor 11 includes a certain number of input/output connections, in particular: eight switches 21 to 28, four analog input connections three of which here are connected with three potentiometers 31 to 33 and the fourth one 34 is connected to an automatic volume control device 50, an output connection 61 for transmitting to the message generator 12 a message number to be transmitted, an output connection 62 for transmitting to the message generator 12 an enabling signal, and a signal receiving input connection 63, active or not, coming from message generator 12. The message generator circuit 12 is connected for transmitting messages to the loudspeakers 41, 42, 43 which in the present case are sound wave transmitter/sensor apparatus in parallel connection with the automatic volume control device 50.

The dual position switches 21 to 28 must be positioned to determine the local operating parameters of the microprocessor, for instance: switch 21 for continuous operation or operation upon pedestrians' request, switch 22 for transmitting or not a message in a first language, switch 23 for transmitting or not a message in a second language, switch 24 for transmitting or not the street name, switch 25 for transmitting or not a message in case crossing is forbidden, switch 26 for transmitting or not a coded message in case crossing is forbidden, switch 27 for operating or not the automatic volume control, and finally switch 28 for activating or not the predetermined delay for the generation proper of the pedestrians request sound message. Similarity, the microprocessor 11 includes, for instance, four analog input terminals which are connected to allow sensing the operating parameters, for instance potentiometer 31 for sensing a minimal message transmission volume, potentiometer 32 to allow sensing a maximum message transmission volume, potentiometer 33 to allow adjusting the predetermined duration of the simultaneity detection, input 34 to allow sensing the ambient sound level coming from the automatic volume control device 50. The microprocessor 11 finally includes a logic input 64 connected with control wire 5 of figurine 3, a logic input 65 connected with control wire 6 of figurine 4, and a logic input 66 connected with pedestrians' request connection 9.

To avoid overloading the description with elements well known by those skilled in the art, the drawing obviously was simplified: some connections may include several wires and some safety devices are not represented. For instance, optocouplers may be provided for connecting control wire 5 (or 6) with logic input 64 (or 65). A digital potentiometer, such as a potentiometer part number EDPOT/X9MME available from XICOR company, can be used for the analog information.

The operation of the sound signaling generation device 10 is as follows. When the power is fed to microprocessor via general switch 15, an initializing routine is performed by the programmable microprocessor to conventionally perform the usual reset operations. Then, a decision loop, as to whether or not message should be transmitted, is performed to step over to the transmission phase, if switch 21 indicates that the microprocessor must operate continuously and, if not, to test the logic input 66 since the microprocessor must then operate upon pedestrians' request. When a pedestrian request 9 caused by activating a push button 7, 8 appears on input 66, switch 28 is tested to step over to the transmission phase either (switch 28 test) immediately if no delay was activated, or after a predetermined delay duration if the delay was activated and the pedestrian's request 9 has been maintained for that duration. As long as no decision was taken regarding stepping to the transmission phase, the microprocessor remains in the decision loop.

When a message transmission has been decided, the microprocessor may in a first step determine the volume of the future message to be transmitted. For this purpose, switch 27 is tested to check whether or not the automatic volume control should be activated. If it is not activated, the transmission volume may, for instance, be determined by the position of the adjustment potentiometer of the minimal message transmission volume 31. If the automatic volume control 50 has been activated, input 34 is tested to determine the ambient sound volume level and, dependent upon this level, the transmission volume is chosen between minimal and a maximal limits set by potentiometers 31 and 32. The microprocessor 11 will then test whether one of both inputs 64 or 65 is present and a non simultaneity check is performed taking into account the duration of authorized simultaneity as provided by potentiometer 33. If an erroneous situation is then detected, the microprocessor may either stay mute, or transmit an error message on the loud speaker. If the situation is normal, the microprocessor decides whether to transmit an authorization message, if input 64 associated with the authorization figurine 3 is present, or to transmit a forbidding message if input 65 associated with figurine 4 is present. In practice, several forbidding and authorization messages exist since switches 22 and 23 must be tested to know which language(s) the message should be transmitted in and switch 24 must be tested to check whether a street name must be transmitted. For these reasons, the microprocessor will determine a message number to be transmitted to the message generator circuit 12 by means of connection 61, and transmission of messages will then be enabled by terminal 62. A forbidding message transmission will be performed according to the same process, except that, before the transmission decision, switch 25 will be tested to decide whether or not a forbidding message should be transmitted, and switch 36 will be tested to check whether or not the transmitted message should be coded. These switch positioning possibilities, in particular regarding 25 and 26, correspond to options which are sometimes requested from the installation companies. Options include transmitting a message only when crossing is authorized and transmitting no message in the other cases; transmitting a spoken message when crossing is forbidden; and transmitting a coded message when crossing is forbidden, with a coded message being for instance a continuous or discontinuous transmission of a constant audible frequency. When the message transmission is operating, the message generator circuit 13 positions connection 63; the transmitted message may be regularly repeated until the position of figurines 3 and 4 changes, i.e. until the position of terminals 64 and 65 is reversed. At this time the microprocessor returns to the message transmission decision routine and the cycle starts again.

Figure 2:
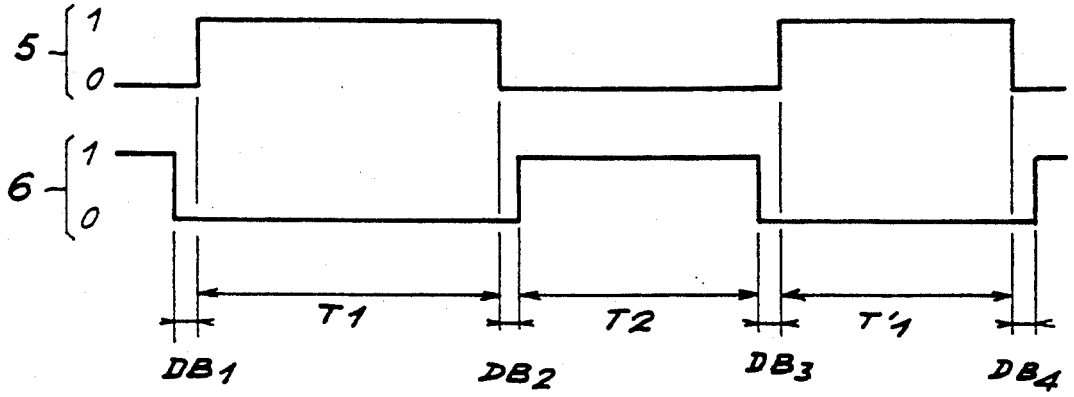
FIG. 2 represents an activation diagram of the optical figurines.

In FIG. 2 the successive values of the control connections 5 and 6 for figurines 3 and 4 are represented; figurines are alternatively lit up, value 1, or switched off, value 0. They are mutually exclusive and operate continuously: the value of connection 5 is 1 during duration T1, T'1, etc., with each duration not being necessarily identical to the previous one, while the value of connection 6 is 1 during duration T2. At each control change, there necessarily is a reversing duration for DB1, DB2, DB3, DB4, the durations of which, although short, are not necessarily identical but always are smaller than a known value to be determined as a function of the local installation. This known value is the one that allows positioning the adjustment potentiometer 33.

Figure 3:
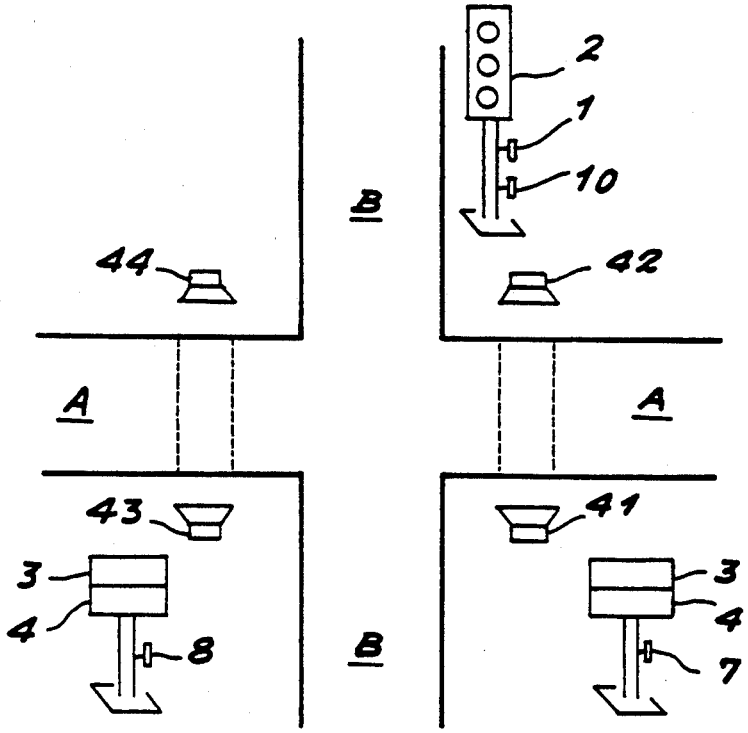
FIG. 3 represents a simple road crossing.

FIG. 3 represents a simple road crossing between streets A and B including the optical signaling devices for pedestrians. Figurines 3 and 4 are synchronized with a controller 1 for road traffic lights, and with a sound signaling generation device 10 for pedestrians. Both crossings of street A may be sound equipped by means of four loud speakers 41, 42, 43, and 44 preferably installed two by two facing one another. The loud speakers, as can be seen, and the non represented associated push buttons as well, are preferably arranged close to the optical signaling figurines, of which there can be four times two. The loud speakers preferably are located facing one another to thus constitute a sound guidance inasmuch as the authorization message is repeated for a sufficiently long period. The number of loud speakers connected in parallel is preferably between one and four, one sound signaling generation device for pedestrians according to the invention thus is provided for one or two crossings of the same street.

Figure 4:
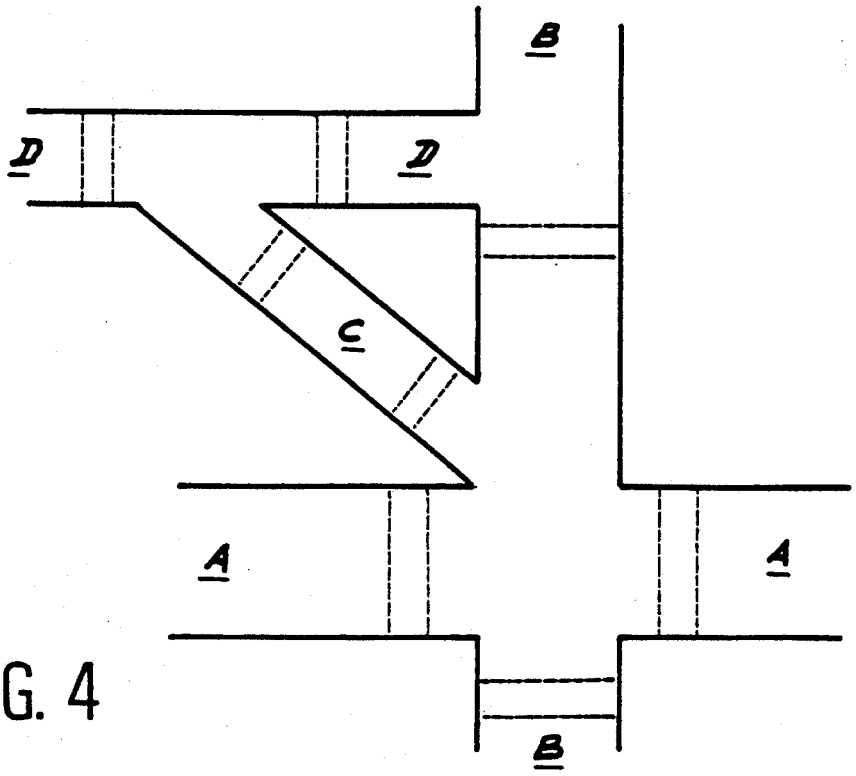
FIG. 4 represents a complex road crossing.

FIG. 4 shows a more complex crossing than in FIG. 3, wherein four streets A, B, C and D are represented, each of which is crossed by two passages. In this case, if it is wished that all passages are sound equipped, four sound signaling generation device 10, as described in FIG. 1, must be installed. Each device will of course be connected with the proper controls for figurines 3 and 4 and with the corresponding push buttons 7, 8, etc. All four devices 10 of FIG. 1 are easily housed in the same cabinet and, in this case, some circuits may be common.

Figure 5:
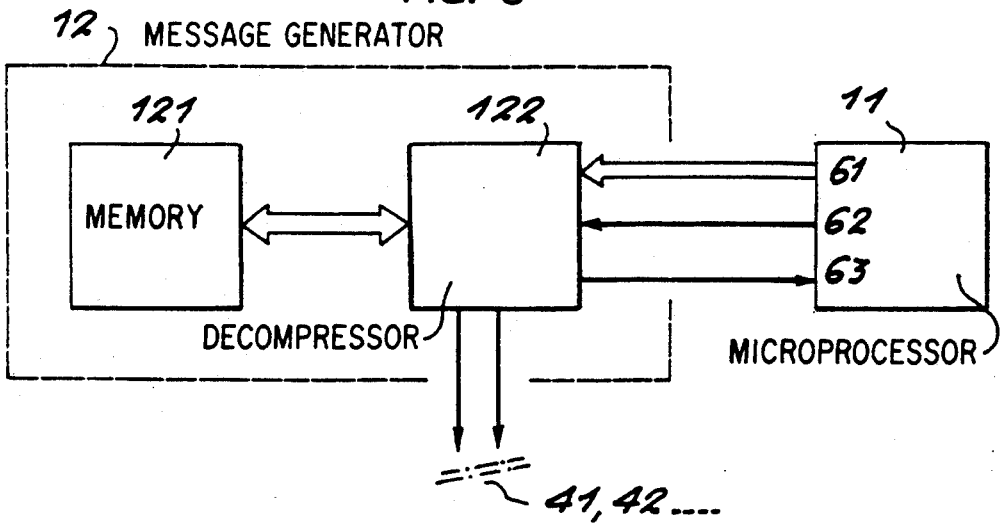
FIG. 5 represents a schematic diagram of a low frequency message reconstruction circuit.

FIG. 5 schematically represents a message generator circuit 12 connected with the microprocessor 11 by means of the already described connections 61, 62, 63. The message generator circuit 12 includes two main parts, i.e. a decompression device 122, and a non volatile memory, for instance an EPROM, 121. During a preparation phase, the various messages to be transmitted were cut in message parts which thus could be stored under a digital form in memory 121. When the microprocessor, during the operation phase, transmits by means of connection 61 a message number to the decompression device 122, the latter will pick up the proper message parts in memory 121 and proceed to their concatenation to reconstruct the requested message, first under a compressed digital form and then under the audio decompressed form to be transmitted to the output connected with the loud speakers 41, 42, 43, 44. This message transmission system is known as ADPCM (Adaptative Differential Pulse Code Modulation) which in particular is used in digital telephony with specifications established by the CCITT. The ADPCM system may for instance be operated with part number UPD7759C of the NEC company.

It is clear that the device described can be modified and nevertheless remain within the scope of the invention. For instance, potentiometer 33 can be used for adjusting the predetermined delay duration of the pushbutton and, in this case, the predetermined period duration of simultaneous detection can be set by software.

We claim:

1. Apparatus for signaling pedestrians at a crosswalk, said apparatus comprising optical signal generating means, sound signal generating means which, when activated, is synchronized with said optical signal generating means, common activating means for said optical signal generating means and said sound signal generating means, said activating means activating said optical signal generating means when an activating maneuver is exerted by a pedestrian, said activating means activating said sound signal generating means only when said maneuver is exerted for a predetermined duration after the activation of said optical signal generating means.

2. Apparatus as in claim 1 further comprising road traffic light means which is controlled by said optical signal generating means.

3. Apparatus as in claim 1 wherein said activating means comprises a push button, said actuating maneuver consisting of pushing said button, said predetermined duration being at least one second.

4. Apparatus as in claim 1 wherein said optical signal generating means generates first and second control signals, said apparatus further comprising first optical indicating means activated by said first control signal for authorizing a crossing, and second optical indicating means activated by said second control signal for forbidding a crossing, said sound signal generating means comprising first sound control means for controlling transmission of a first sound message authorizing a crossing, said first sound control means being actuated by said first control signal, and second sound control means for controlling transmission of a second sound message forbidding a crossing, said second sound control means being activated by said second control signal.

5. Apparatus as in claim 4 further comprising error detection means which transmits an error signal if said first and second control signals are either simultaneously present or simultaneously absent for a predetermined period of time.

6. Apparatus as in claim 5 wherein said sound signal generating means comprises a programmable microprocessor having logic and analog inputs and outputs.

7. Apparatus as in claim 6 wherein said microprocessor comprises four analog input terminals, said apparatus further comprising the following connected with respective terminals:

a. an adjustment potentiometer for setting a minimum message transmission volume, b. an adjustment potentiometer for setting a maximum message transmission volume, c. an adjustment potentiometer for adjusting the predetermined period of time of said simultaneity detection, and d. an ambient sound level sensor.

8. Apparatus as in claim 6 wherein said microprocessor comprises eight logic input terminals, said apparatus further comprising eight dual-position switches connected with respective terminals to determine a. whether the microprocessor operates in a continuous way or upon pedestrian's request, b. whether or not each message is transmitted in the first language, c. whether or not each message is transmitted in a second language, d. whether or not each message is transmitted with a street name, e. whether or not a message is transmitted if crossing is forbidden, f. whether or not a coded message is transmitted in case crossing is forbidden, g. whether or not an automatic volume control is activated, h. whether or not said predetermined duration is activated.

9. Apparatus as in claim 1 further comprising a plurality of message transmitters connected in parallel, said message transmitters being responsive to signals generated by said sound signal generating means, a like plurality of ambient sound sensors associated with respective message transmitters, and means for determining an average ambient sound level based on inputs from said sensors.

10. Apparatus as in claim 1 wherein said sound signal generating means comprises means for storing messages to be transmitted in portions which are digitized, means for reconstructing a message by concatenation of message portions, and means for restoring a message by digital decompression of said message after concatenation.

* * * * *